US006627779B2

(12) United States Patent
O'Rear

(10) Patent No.: US 6,627,779 B2
(45) Date of Patent: Sep. 30, 2003

(54) LUBE BASE OILS WITH IMPROVED YIELD

(75) Inventor: Dennis J. O'Rear, Petaluma, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 22 days.

(21) Appl. No.: 09/999,873

(22) Filed: Oct. 19, 2001

(65) Prior Publication Data

US 2003/0088133 A1 May 8, 2003

(51) Int. Cl.[7] ..... C10M 105/06; C10M 104/02; C10M 159/06; C07C 2/54

(52) U.S. Cl. ..... 585/302; 585/1; 585/7; 585/13; 208/18; 208/19

(58) Field of Search ..... 585/13, 7, 1, 302; 208/18, 19

(56) References Cited

U.S. PATENT DOCUMENTS

| | | | |
|---|---|---|---|
| 4,176,050 A | 11/1979 | Chen et al. | |
| 4,181,598 A | 1/1980 | Gillespie et al. | |
| 4,211,635 A | 7/1980 | Chen | |
| 4,222,855 A | 9/1980 | Pelrine et al. | |
| 4,229,282 A | 10/1980 | Peters et al. | |
| 4,440,871 A | 4/1984 | Lok et al. | |
| 4,456,527 A | 6/1984 | Buss et al. | |
| 4,507,517 A | 3/1985 | Devries et al. | |
| 4,599,474 A | 7/1986 | Devries et al. | |
| 4,704,487 A | 11/1987 | Devries et al. | |
| 4,704,493 A | 11/1987 | Devries et al. | |
| 4,709,108 A | 11/1987 | Devries et al. | |
| 4,734,537 A | 3/1988 | Devries et al. | |
| 4,814,533 A | 3/1989 | Devries et al. | |
| 4,814,534 A | 3/1989 | Devries et al. | |
| 4,814,538 A | 3/1989 | Devries et al. | |
| 4,911,821 A | 3/1990 | Katzer et al. | |
| 5,135,638 A | 8/1992 | Miller | |
| 5,282,958 A | 2/1994 | Santilli et al. | |
| 5,602,086 A | 2/1997 | Le et al. | |
| 5,726,133 A | 3/1998 | Blahey et al. | |
| 5,906,969 A | 5/1999 | Fyfe | |
| 5,958,849 A | 9/1999 | Hewson et al. | |
| 6,392,109 B1 * | 5/2002 | O'Rear et al. | 585/323 |

FOREIGN PATENT DOCUMENTS

| | | |
|---|---|---|
| EP | 0609079 A1 | 8/1994 |
| EP | 0921184 A1 | 6/1999 |
| WO | WO 00/14188 A2 | 3/2000 |

OTHER PUBLICATIONS

Bacha, J.D., et al., *Diesel Fuel Stability and Instability: A Simple Conceptual Model, IASH 2000, the 7th International Conference on Stability and Handling of Liquid Fuels,* Graz, Austria, Sep. 24–29, 2000, pp. 1–7.

(List continued on next page.)

*Primary Examiner*—Thuan D. Dang
(74) *Attorney, Agent, or Firm*—Burns, Doane, Swecker & Mathis, L.L.P.

(57) ABSTRACT

The invention provides methods for preparing a blended lube base oils comprising at least one highly paraffinic Fischer Tropsch lube base stocks and at least one base stock composed of alkylaromatics, alkylcycloparaffins, or mixtures thereof. The use of base stocks composed of alkylaromatics, alkylcycloparaffins, or mixtures thereof improves the yield of lube base oils from Fischer Tropsch facilities, as well as provides moderate improvements in physical properties including additive solubility. The invention provides processes for obtaining such blended lube base oils using the products of Fischer Tropsch processes.

21 Claims, 1 Drawing Sheet

OTHER PUBLICATIONS

Broughton, D.B., *Adsorptive Separation* (*Liquids*), *Kirk–Othmer: Enclyclopedia of Chemical Technology, A to Alkanolamines,* vol. 1, 3rd Ed., 1978, pp. 563–581, Wiley–Interscience Publication, John Wiley & Sons, New York.

Little, D.M., *Catalytic Reforming,* 1985, PennWell Publishing Company, Tulsa, Oklahoma.

*Handbook of Petroleum Refining Processes,* R.A. Meyers, editor, Table of Contents, 1986, McGraw–Hill, Inc.

Mushrush, G.W. et al., *Instability and Incompatibility, Structure of Jet Fuels VI: Preprints Symposia,* Division of Petroleum Chemistry, Inc., vol. 45, No. 3, Jul. 2000, pp. 433–434, American Chemical Society.

*New Japanese Processes Promise Cheaper Styrene & Xylenes, Petroleum & Petrochemical International,* Dec. 1972, vol. 12, No. 12., pp 64–68.

Schultz, R.C. et al, *Lab Production, Second World Conference on Detergents, Looking Towards the 90's,* Montreux, Switzerland, Oct. 5 through 19, 1986, pp. 260–267, American Oil Chemists' Society.

U.S. patent application Ser. No. 09/514,958, Dennis J. O'Rear, et al., *Synthesis of Alkylbenzenes and Synlubes from Fischer–Tropsch Products,* Filed on Feb. 29, 2000, attorney docket No. 005950–516.

* cited by examiner

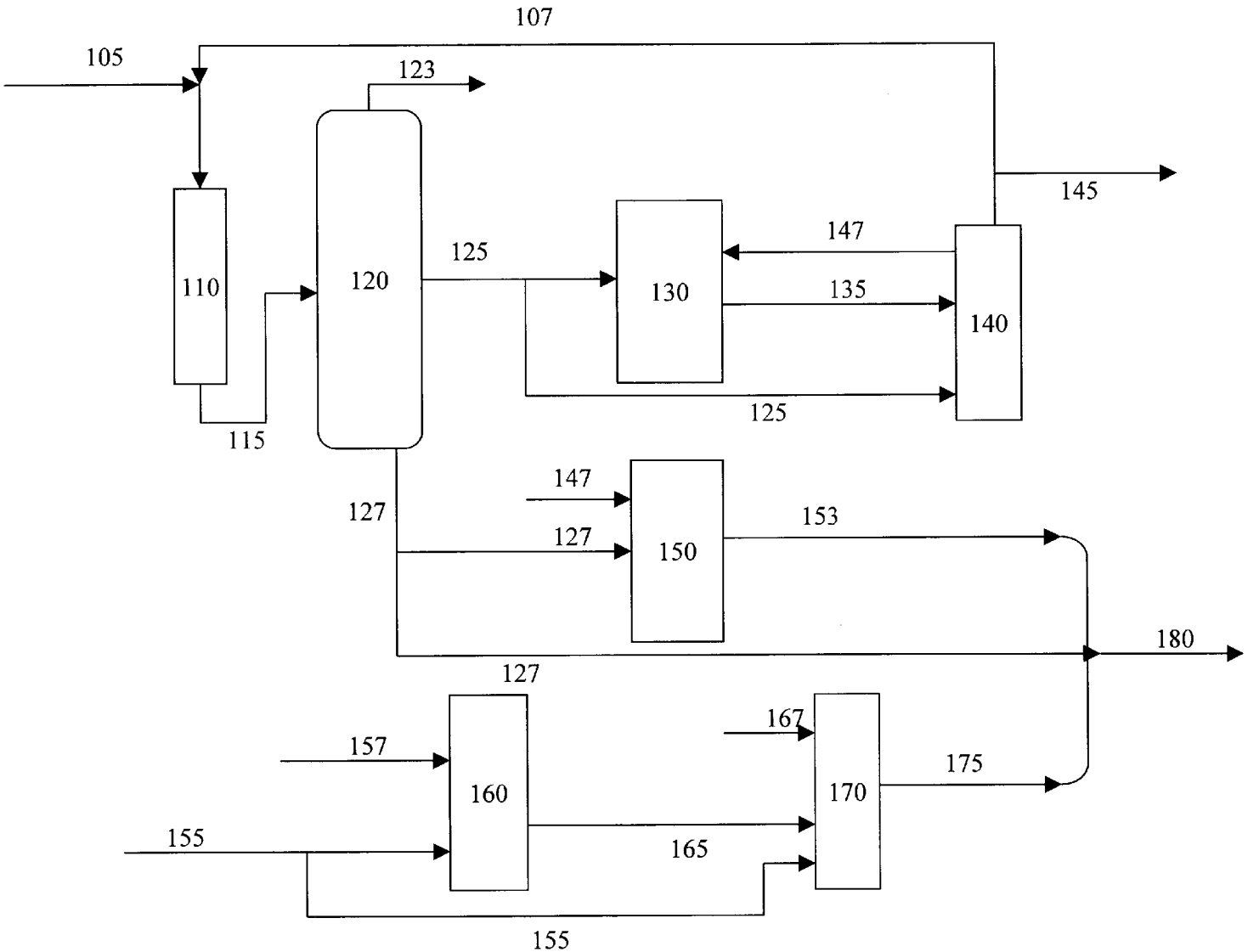
105
107
110
115
120
123
125
125
130
135
147
140
145
127
127
150
147
153
180
127
160
157
155
165
170
167
175
155

LUBE BASE OILS WITH IMPROVED YIELD

FIELD OF THE INVENTION

The present invention relates to the use of alkylaromatics and alkylcycloparaffins in Fischer Tropsch lube base oils to provide improved yields, as well as to provide moderate improvements in the physical properties of the oil.

BACKGROUND OF THE INVENTION

Finished lubricants used for automobiles, diesel engines, and industrial applications consist of two general components: a lube base oil and additives. In general, a few lube base oils are used to generate a wide variety of finished lubricants by varying the mixtures of individual lube base oils and individual additives. Typically, lube base oils are simply hydrocarbons prepared from petroleum or other sources. Lube base oils are valuable commodities and are treated as essentially items of commerce. As items of commerce, they are bought, sold, and exchanged.

The majority of lube base oils used in the world today are derived from crude oil. There are several limitations to using crude oil as a source. Crude oil is in limited supply; it includes aromatic compounds that may be harmful and irritating, and it contains sulfur and nitrogen-containing compounds that can adversely affect the environment, for example, by producing acid rain.

Lube base oils can also be prepared from natural gas. This preparation involves converting the natural gas, which is mostly methane, to synthesis gas, or syngas, which is a mixture of carbon monoxide and hydrogen. An advantage of using products prepared from syngas is that they do not contain nitrogen and sulfur and generally do not contain aromatic compounds. Accordingly, they have minimal health and environmental impact.

Fischer-Tropsch chemistry is typically used to convert the syngas to a product stream that includes lube base oils, among other products. These Fischer Tropsch products have very low levels of sulfur, nitrogen, aromatics and cycloparaffins. The Fischer Tropsch derived products are considered environmentally friendly. Although environmentally desirable, only a small fraction of the world's lube base oil supply is derived from Fischer Tropsch derived products. In addition, even though the properties of Fischer Tropsch derived lube base oils may make them environmentally friendly, the physical properties of these highly paraffinic lube base oils may in some respects limit their use. For example, due to their high paraffin content, Fischer Tropsch lube base stocks may exhibit poor additive solubility. Lube base additives typically have polar functionality; therefore, they may be insoluble or only slightly soluble in highly Fischer Tropsch lube base stocks.

To address the problem of poor additive solubility in highly paraffinic base stocks, various co-solvents, such as synthetic esters, are currently used. However, these synthetic esters are very expensive, and thus, the blends of the highly paraffinic Fischer Tropsch lube base oils containing synthetic esters, which have acceptable additive solubility, are also expensive. The high price of these blends limits the current use of highly paraffinic Fischer Tropsch base oils to specialized and small markets.

Therefore, there is a need for efficient and economical methods of increasing the yield of lube base oils from Fischer Tropsch facilities. In addition, there is a need for methods to improve certain physical properties, such as additive solubility, of highly paraffinic Fischer Tropsch lube base stocks to make their use more widespread and economical. The present invention provides such a method.

SUMMARY OF THE INVENTION

One aspect of the present invention relates to a lubricant comprising: a) at least one highly paraffinic Fischer-Tropsch derived lube base stock having a viscosity of greater than 3 cSt when measured at 40° C., having a branching index of less than 5, and having an average length of alkyl side branches of less than 2 carbon atoms; and b) at least one lube base stock composed of alkylaromatics, alkylcycloparaffins, or mixtures thereof and having a viscosity of greater than 2 cSt when measured at 40° C. The resulting lubricant comprises component b) in an amount between 1 wt % and 50 wt %, and the lubricant has viscosity of greater than 3 cSt when measured at 40° C. The lubricant of the present invention may further comprise: one or more tube base oil additives and an effective amount of synthetic ester co-solvent to reduce turbidity of the lubricant to below two. The effective amount of ester co-solvent in the lubricant is less than the amount that would be required to reduce the turbidity to below two if the lubricant did not contain component (b).

An additional aspect of the present invention relates to an integrated process for producing highly paraffinic Fischer-Tropsch lube base stocks, alkylaromatics boiling in lube base oil range and/or an alkylcycloparaffins boiling in the lube base oil range. This process preferably involves the utilization of feedstocks obtained from a Fischer-Tropsch process.

In another aspect of the present invention, an integrated process for preparing a blended lube base oil is provided. The process comprises the step of blending (i) at least one Fischer-Tropsch derived lube base stock having a viscosity of greater than 3 cSt when measured at 40° C. and having a branching index of less than 5 and (ii) at least one lube base stock composed of alkyaromatics, alkylcycloparaffins, or mixtures thereof and having a viscosity of greater than 2 cSt when measured at 40° C. This process preferably involves the utilization of feedstocks obtained from a Fischer-Tropsch process.

In yet another aspect of the present invention, a process for increasing the yield of lube base oil from a Fischer Tropsch facility is provided. This process comprises performing Fischer-Tropsch synthesis on syngas to provide a product stream and fractionally distilling the product stream and isolating a $C_{20+}$ fraction, a light aromatics fraction, and a light Fischer Tropsch products fraction containing olefins, alcohols, and mixtures thereof. The light aromatics fraction is alkylated with the light products fraction to provide an alkylaromatics fraction. Products from both the $C_{20+}$ fraction and the alkylaromatics fraction are blended after optional further processing to provide a lube base oil. By using products prepared from the $C_{20+}$ fraction and the alkylaromatics in the lube base oil, the overall yield of lube base oil from the Fischer Tropsch facility is increased.

A further aspect of the present invention relates to an integrated process for preparing a blended lube base oil. This process comprises subjecting light Fischer Tropsch products containing olefins, alcohols, or mixtures thereof to alkylation under catalytic alkylation conditions to form an alkylated stream and subjecting the alkylated stream to distillation to obtain alkylaromatics boiling in the lube base oil range and reformable Fischer Tropsch products. This process further comprises subjecting Fischer Tropsch derived wax to hydroisomerizing conditions to form highly paraffinic lube base stock. In this process the alkylaromatics and the highly paraffinic lube base stock are blended to form the blended lube base oil.

In another aspect of the present invention, an integrated process for preparing a blended lube base oil is provided. This process comprises subjecting light Fischer Tropsch products containing olefins, alcohols, or mixtures thereof to alkylation under catalytic alkylation conditions to form an alkylated stream and subjecting the alkylated stream to distillation to obtain alkylaromatics boiling in the lube base oil range and reformable Fischer Tropsch products. The process may further comprise subjecting the reformable Fischer Tropsch products to reforming under catalytic reforming conditions to form a light aromatic stream that may be recycled to the alkylation zone to form additional alkylaromatics boiling in the lube base oil range. Optionally a portion of the alkylaromatics boiling in the lube base oil range obtained from the distillation may be subjected to hydrogenation under catalytic hydrogenating conditions to obtain alkylcycloparaffins boiling in the lube base oil range. The process also comprises subjecting Fischer Tropsch derived wax to hydroisomerizing conditions to form highly paraffinic lube base stock. In this process, the highly paraffinic lube base stock is blended with the alkylaromatics and optionally the alkylcycloparaffins boiling in the lube base oil range to form the blended lube base oil.

BRIEF DESCRIPTION OF THE DRAWINGS

The FIGURE illustrates a block diagram of a specific embodiment of a Fischer Tropsch process for making a blended lube base oil.

DETAILED DESCRIPTION OF ILLUSTRATIVE EMBODIMENTS

According to the present invention, it has been found that alkylaromatics and alkylcycloparaffins may be added to highly paraffinic Fischer Tropsch derived lube base stocks to provide a blended lube base oil with improved physical properties and to increase the overall yield of lube base oil from the Fischer Tropsch facility. A Fischer Tropsch process generates a significant quantity of products that boil lighter than the lightest lube base stock fraction; thus, the percent yield of lube base oil from a Fischer Tropsch facility is smaller than ideally desired. These lighter fractions may be converted into alkylaromatics and alkylcycloparaffins boiling in the lube base oil range.

The alkylaromatics and alkylcycloparaffins boiling in the lube base oil range may be used to provide a base stock composed of alkylaromatics, alkylcycloparaffins, or mixtures thereof. The base stock composed of alkylaromatics, alkycycloparaffins, or mixtures thereof has a viscosity of greater than 2 cSt. The content of alkylaromatics and/or alkylcycloparaffins in this base stock is at least 10 wt %, preferably greater than 50 wt %, more preferably greater than 75 wt %, and most preferably essentially 100 wt %.

The base stock composed of alkylaromatics, alkylcycloparaffins, or combinations thereof may be blended into highly paraffinic Fischer Tropsch lube base stocks. Addition of alkylaromatics and alkylcycloparaffins to highly paraffinic Fischer Tropsch lube base stocks increases the overall yield of lube base oil from the Fischer Tropsch facility and thus provides a more efficient and economical method of making lube base oils from a Fischer Tropsch facility.

In addition to improved yield, it has been discovered that addition of alkylaromatics and alkylcycloparaffins to highly paraffinic Fischer Tropsch lube base stocks provides moderate improvements in other physical properties of the blended lube base oil. For example, moderate improvements in additive solubility may be obtained by addition of these components to highly paraffinic Fischer Tropsch lube base stocks.

Definitions

The following terms will be used throughout the specification and will have the following meanings unless otherwise indicated.

The term "alkyl" as used herein means a straight-chain or branched saturated monovalent hydrocarbon of one to forty carbon atoms, e.g., methyl, ethyl, i-propyl, and the like.

The term "paraffin" means any saturated hydrocarbon compound, i.e., an alkane.

The term "aromatic" means any hydrocarbonaceous compound that contains at least one group of atoms that share an uninterrupted cloud of delocalized electrons, where the number of delocalized electrons in the group of atoms corresponds to a solution to the Huckel rule of 4n+2 (e.g., n=1 for 6 electrons, etc.). Representative examples include, but are not limited to, benzene, biphenyl, naphthalene, and the like.

The term "alkylaromatic" means any compound that contains at least one aromatic ring with at least one attached alkyl group. This group includes, for example, alkylbenenes, alkylnaphthalenes, alkyltetralines, and alkylpolynuclear aromatics. Of these, alkylbenzenes are the preferred alkylaromatic.

The term "cycloparaffin" means any saturated monovalent cyclic hydrocarbon radical of three to eight ring carbons, i.e., cycloalkane. Cycloparaffins may include, for example, cyclohexyl, cyclopentyl, and the like.

The term "alkylcycloparaffin" means any compounds that contain at least one cycloparaffinic ring (typically a $C_6$ or $C_5$ ring, preferably a $C_6$ ring) with at least one attached alkyl group. This group includes, for example, alkylcyclohexanes, alkylcyclopentane, alkyldicycloparaffins, and alkylpolycycloparaffins. Of these, alkylcyclohexanes and alkylcyclopentanes are preferred, with alkylcyclohexanes especially preferred.

The term "lube base stock" or "base stock" means hydrocarbons in the lube base oil range that have acceptable viscosity index and viscosity for use in making finished lubes. Lube base stocks are mixed with additives to form finished lubricants.

The term "lube base stock slate" or "base stock slate" means a product line of base stocks that have different viscosities but are the same base stock grouping and are from the same manufacturer.

The term "lube base oil" or "base oil" means a material following the American Petroleum Institute Interchange Guidelines (API Publication 1509). A lube base oil comprises a base stock or blend of base stocks.

The term "base stock composed of alkylaromatics and/or alkylcycloparaffins" means a base stock that contains these compounds and has a viscosity greater than 2 cSt. The content of alkylaromatics and/or alkylcycloparaffins in this base stock is at least 10 wt %, preferably greater than 50 wt %, more preferably greater than 75 wt %, and most preferably essentially 100 wt %.

The term "formulated lubricant" means a blend composed of at least one base stock or base oil with at least one additive.

The term "highly paraffinic base stock" means a lube base stock that has greater than 70% paraffins, preferably greater than 85% paraffins, and most preferably greater than 95% paraffins.

The term "viscosity index" (VI) refers to the measurement defined by ASTM D 2270-93.

The term "synthetic lube base oil" refers to oil produced by chemical synthesis rather than by extraction and refinement from crude petroleum oil. Synthetic lube base oils meet the API Interchange Guidelines and are preferably prepared by Fischer Tropsch synthesis.

The term "Fischer Tropsch waxy fraction/stream/product" means a product derived from a Fischer Tropsch process generally boiling above 600° F., preferably above 650° F. The Fischer Tropsch waxy products are generally $C_{20+}$ products, with decreasing amounts down to $C_{10}$. Fischer Tropsch waxy products generally comprise >70% normal paraffins, and often greater than 80% normal paraffins. Fischer Tropsch waxy products may be converted to highly paraffinic Fischer Tropsch lube base stocks by a hydroisomerization process.

The term "light Fischer Tropsch product/feedstock containing olefins and alcohols" means a product derived from a Fischer Tropsch process that contains olefins and/or alcohols and boils between ethylene and 700° F. It preferably boils between propylene and 400° F.

The term "reformable Fischer Tropsch product" means a product derived from a Fischer Tropsch process that can be reformed to aromatics. A reformable light fraction typically boils below about 400° F., and preferably a reformable light fraction contains hydrocarbons boiling above n-pentane and below 400° F. More preferably the boiling range of the reformable light fraction is limited to produce single ring aromatics which boil above n-pentane (97° C.) and below n-decane (346° C.). Most preferably, the boiling range is selected to limit the production to benzene, which corresponds to a boiling range above n-hexane and below n-decane.

The term "heavy Fischer Tropsch product" means a product derived from a Fischer Tropsch process that boils above the range of commonly sold distillate fuels: naphtha, jet or diesel fuel. This means greater than 400° F., preferably greater than 550° F., and most preferably greater than 700° F. This stream may be converted to olefins by a thermal cracking process.

"Syngas" is a mixture that includes hydrogen and carbon monoxide. In addition to these species, others may also be present, including, for example, water, carbon dioxide, unconverted light hydrocarbon feedstock, and various impurities.

"Branching index" means a numerical index for measuring the average number of side chains attached to a main chain of a compound. For example, a compound that has a branching index of two means a compound having a straight chain main chain with an average of approximately two side chains attached thereto. The branching index of a product of the present invention may be determined as follows. The total number of carbon atoms per molecule is determined. A preferred method for making this determination is to estimate the total number of carbon atoms from the molecular weight. A preferred method for determining the molecular weight is Vapor Pressure Osmometry following ASTM D-2503, provided that the vapor pressure of the sample inside the Osmometer at 45° C. is less than the vapor pressure of toluene. For samples with vapor pressures greater than toluene, the molecular weight is preferably measured by benzene freezing point depression. Commercial instruments to measure molecular weight by freezing point depression are manufactured by Knauer. ASTM D-2889 may be used to determine vapor pressure. Alternatively, molecular weight may be determined from an ASTM D-2887 or ASTM D-86 distillation by correlations which compare the boiling points of known n-paraffin standards.

The fraction of carbon atoms contributing to each branching type is based on the methyl resonances in the carbon NMR spectrum and uses a determination or estimation of the number of carbons per molecule. The area counts per carbon is determined by dividing the total carbon area by the number of carbons per molecule. Defining the area counts per carbon as "A", the contribution for the individual branching types is as follows, where each of the areas is divided by area A:

2–branches=half the area of methyls at 22.5 ppm/A

3–branches=either the area of 19.1 ppm or the area at 11.4 ppm (but not both)/A

4–branches=area of double peaks near 14.0 ppm/A

4+branches area of 19.6 ppm/A minus the 4–branches internal ethyl branches=area of 10.8 ppm/A The total branches per molecule (i.e. the branching index) is the sum of areas above.

For this determination, the NMR spectrum is acquired under the following quantitative conditions: 45 degree pulse every 10.8 seconds, decoupler gated on during 0.8 sec acquisition. A decoupler duty cycle of 7.4% has been found to be low enough to keep unequal Overhauser effects from making a difference in resonance intensity.

In a specific example, the molecular weight of a Fischer Tropsch Diesel Fuel sample, based on the 50% point of 478° F. and the API gravity of 52.3, was calculated to be 240. For a paraffin with a chemical formula $C_nH_{2n+2}$, this molecular weight corresponds to an average number n of 17.

The NMR spectrum acquired as described above had the following characteristic areas:

2–branches=half the area of methyl at 22.5 ppm/A=0.30

3–branches=area of 19.1 ppm or 11.4 ppm not both/A=0.28

4–branches=area of double peaks near 14.0 ppm/A=0.32

4+branches=area of 19.6 ppm/A minus the 4–branches=0.14 internal ethyl branches=area of 10.8 ppm/A=0.21

The branching index of this sample was found to be 1.25.

The term "integrated process" means a process comprising a sequence of steps, some of which may be parallel to other steps in the process, but which are interrelated or somehow dependent upon either earlier or later steps in the total process.

The term "naphtha" is typically the $C_5$ to 400° F. endpoint fraction of available hydrocarbons. The boiling point ranges of the various product fractions recovered in any particular refinery or synthesis process will vary with such factors as the characteristics of the source, local markets, product prices, etc. Reference is made to ASTM D-3699-83 and D-3735 for further details on kerosene and naphtha fuel properties.

The term "iso-paraffin content" refers to the concentration of iso-paraffins in a sample. Iso-paraffins are defined as branched alkanes, and do not include normal alkanes and cycloalkanes. For Fischer Tropsch lube base oils with acceptable pour points, the concentration of normal paraffins is usually very small and accordingly, the concentration of iso-paraffins is high.

The specifications for lube base oils are defined in the API Interchange Guidelines (API Publication 1509) using sulfur content, saturates content, and viscosity index, as follows:

| Group | Sulfur, ppm | And/or | Saturates, % | Viscosity Index (V.I.) |
|---|---|---|---|---|
| I | >300 | And/or | <290 | 80–120 |
| II | <300 | And | >90 | 80–120 |
| III | <300 | And | >90 | >120 |
| IV | All Polyalphaolefins (PAOs) | | | |
| V | All Stocks Not Included in Groups I–IV | | | |

Plants that make Group I base oils typically use solvents to extract the lower viscosity index (VI) components and increase the VI of the crude to the specifications desired. These solvents are typically phenol or furfural. Solvent extraction gives a product with less than 90% saturates and more than 300 ppm sulfur. The majority of the lube production in the world is in the Group I category.

Plants that make Group II base oils typically employ hydroprocessing such as hydrocracking or severe hydrotreating to increase the VI of the crude oil to the specification value. The use of hydroprocessing typically increases the saturate content above 90 and reduces the sulfur below 300 ppm. Approximately 10% of the lube base oil production in the world is in the Group II category, and about 30% of U.S. production is Group II.

Plants that make Group III base oils typically employ wax isomerization technology to make very high VI products. Since the starting feed is waxy vacuum gas oil (VGO) or wax which contains all saturates and little sulfur, the Group III products have saturate contents above 90 and sulfur contents below 300 ppm. Fischer Tropsch wax is an ideal feed for a wax isomerization process to make Group III lube oils. Only a small fraction of the world's lube supply is in the Group III category.

Group IV lube base oils are derived by oligomerization of normal alpha olefins and are called poly alpha olefin (PAO) lube base oils. Group V lube base oils are all others. This group includes synthetic esters, silicon lubricants, halogenated lube base oils and lube base oils with VI values below 80. The latter can be described as petroleum-derived Group V lube base oils. Petroleum-derived Group V lube base oils typically are prepared by the same processes used to make Group I and II lube base oils, but under less severe conditions.

According to the present invention, the highly paraffinic lube base stocks are prepared from a Fischer Tropsch process, and some, or preferably all, of the alkyaromatics and alkylcycloparaffins boiling in the lube base oil range may also be prepared from products of Fischer Tropsch processes. The highly paraffinic Fischer Tropsch base stocks of the invention may be utilized to make Group III or Group II lube base oils; therefore, the blended lube base oils of the invention are Group III or Group II lube base oils.

Catalysts and conditions for performing Fischer-Tropsch synthesis are well known to those of skill in the art, and are described, for example, in EP 0 921 184 A1, the contents of which are hereby incorporated by reference in their entirety. In the Fischer-Tropsch synthesis process, synthesis gas (syngas) is converted to liquid hydrocarbons by contact with a Fischer-Tropsch catalyst under reactive conditions. Typically, methane and optionally heavier hydrocarbons (ethane and heavier) can be sent through a conventional syngas generator to provide synthesis gas. Generally, synthesis gas contains hydrogen and carbon monoxide, and may include minor amounts of carbon dioxide and/or water. The presence of sulfur, nitrogen, halogen, selenium, phosphorus and arsenic contaminants in the syngas is undesirable. For this reason, and depending on the quality of the syngas, it is preferred to remove sulfur and other contaminants from the feed before performing the Fischer Tropsch chemistry. Means for removing these contaminants are well known to those of skill in the art. For example, ZnO guardbeds are preferred for removing sulfur impurities. Means for removing other contaminants are well known to those of skill in the art. It also may be desirable to purify the syngas prior to the Fischer Tropsch reactor to remove carbon dioxide produced during the syngas reaction and any additional sulfur compounds not already removed. This can be accomplished, for example, by contacting the syngas with a mildly alkaline solution (e.g., aqueous potassium carbonate) in a packed column.

In the Fischer Tropsch process, liquid and gaseous hydrocarbons are formed by contacting a synthesis gas comprising a mixture of $H_2$ and CO with a Fischer Tropsch catalyst under suitable temperature and pressure reactive conditions. The Fischer Tropsch reaction is typically conducted at temperatures of about 300 to 700° F. (149 to 371° C.), preferably about from 400 to 550° F. (204 to 228° C.); pressures of about from 10 to 600 psia, (0.7 to 41 bars), preferably 30 to 300 psia, (2 to 21 bars) and catalyst space velocities of from about 100 to about 10,000 cc/g/hr., preferably 300 to 3,000 cc/g/hr.

Examples of conditions for performing Fischer-Tropsch type reactions are well known to those of skill in the art. Suitable conditions are described, for example, in U.S. Pat. Nos. 4,704,487, 4,507,517, 4,599,474, 4,704,493, 4,709,108, 4,734,537, 4,814,533, 4,814,534 and 4,814,538, the contents of each of which are hereby incorporated by reference in their entirety.

The products of the Fischer Tropsch synthesis process may range from $C_1$ to $C_{200+}$ with a majority in the $C_5$ to $C_{100+}$ range, and the products may be distributed in one or more product fractions. The reaction can be conducted in a variety of reactor types, for example, fixed bed reactors containing one or more catalyst beds, slurry reactors, fluidized bed reactors, or a combination of different type reactors. Such reaction processes and reactors are well known and documented in the literature. In the Fischer Tropsch process, the desired Fischer Tropsch product typically will be isolated by distillation.

A slurry Fischer-Tropsch process, which is a preferred process in the practice of the invention, utilizes superior heat (and mass) transfer characteristics for the strongly exothermic synthesis reaction and is able to produce relatively high molecular weight, paraffinic hydrocarbons when using a cobalt catalyst. In a slurry process, a syngas comprising a mixture of $H_2$ and CO is bubbled up as a third phase through a slurry in a reactor which comprises a particulate Fischer-Tropsch type hydrocarbon synthesis catalyst dispersed and suspended in a slurry liquid comprising hydrocarbon products of the synthesis reaction which are liquid at the reaction conditions. The mole ratio of the hydrogen to the carbon monoxide may broadly range from about 0.5 to 4, but is more typically within the range of from about 0.7 to 2.75 and preferably from about 0.7 to 2.5. A particularly preferred Fischer-Tropsch process is taught in EP 0609079, herein incorporated by reference in its entirety.

The products from Fischer-Tropsch reactions performed in slurry bed reactors generally include a light reaction product and a waxy reaction product. The light reaction product (i.e. the condensate fraction) includes hydrocarbons boiling below about 700° F. (e.g., tail gases through middle distillates), largely in the $C_5$–$C_{20}$ range, with decreasing amounts up to about $C_{30}$. The waxy reaction product (i.e., the wax fraction) includes hydrocarbons boiling above 600° F. (e.g., vacuum gas oil through heavy paraffins), largely in the $C_{20}$+ range, with decreasing amounts down to $C_{10}$. Both the light reaction product and the waxy product are substantially paraffinic. The waxy product generally comprises greater than 70% normal paraffins, and often greater than 80% normal paraffins. The light reaction product comprises paraffinic products with a significant proportion of alcohols and olefins. In some cases, the light reaction product may comprise as much as 50%, and even higher, alcohols and olefins.

The product from the Fischer-Tropsch process may be further processed using, for example, hydrocracking, hydroisomerization, and hydrotreating. Such processes crack the larger synthesized molecules into fuel range and lube range molecules with more desirable boiling points, pour points, and viscosity index properties. Such processes may also saturate oxygenates and olefins to meet the particular needs of a refinery. These processes are well known in the art and do not require further description here.

In general, suitable Fischer-Tropsch catalysts comprise one or more Group VIII catalytic metals such as Fe, Ni, Co, Ru and Re. Additionally, a suitable catalyst may contain a promoter. Thus, a preferred Fischer-Tropsch catalyst comprises effective amounts of cobalt and one or more of Re, Ru, Pt, Fe, Ni, Th, Zr, Hf, U, Mg and La on a suitable inorganic support material, preferably one which comprises one or more refractory metal oxides. In general, the amount of cobalt present in the catalyst is between about 1 and about 50 weight percent of the total catalyst composition. The catalysts can also contain basic oxide promoters such as $ThO_2$, $La_2O_3$, MgO, and $TiO_2$, promoters such as $ZrO_2$, noble metals (Pt, Pd, Ru, Rh, Os, Ir), coinage metals (Cu, Ag, Au), and other transition metals such as Fe, Mn, Ni, and Re. Support materials including alumina, silica, magnesia and titania or mixtures thereof may be used. Preferred supports for cobalt containing catalysts comprise titania. Useful catalysts and their preparation are known to those of skill in the art.

Certain catalysts are known to provide chain growth probabilities that are relatively low to moderate, for example, iron-containing catalysts, and the reaction products include a relatively high proportion of low molecular ($C_{2-8}$) weight olefins and a relatively low proportion of high molecular weight ($C_{30}$+) waxes. Certain other catalysts are known to provide relatively high chain growth probabilities, for example, cobalt-containing catalysts, and the reaction products include a relatively low proportion of low molecular ($C_{2-8}$) weight olefins and a relatively high proportion of high molecular weight ($C_{30}$+) waxes. Such catalysts are well known to those of skill in the art and can be readily obtained and/or prepared. The preferred catalysts of this invention contain either Fe or Co, with Co being preferred.

The present invention provides processes that utilize the various products obtained or obtainable from a Fischer Tropsch reaction. The processes described herein provide Fischer Tropsch waxy fractions that can be processed to provide Fischer Tropsch derived lube base stocks. The Fischer Tropsch derived lube base stocks are highly paraffinic and have a low sulfur content. Thus, Fischer Tropsch derived lube base stocks may be utilized to make lube base oils in the Group III or Group II category.

The processes described herein also provide products that boil lighter than the lightest lube base stock fraction (i.e., the lightest fraction having a flash point within the lube base oil range). These lighter products can be converted into alkylaromatics and alkylcycloparaffins that boil in the lube base oil range and these alkylaromatics and alkylcycloparaffins may be used to provide a lube base stock composed of alkylaromatics, alkylcycloparaffins, or mixtures thereof. For example, in one aspect, the present invention provides a process for making a blended lube base oil comprising (i) Fischer Tropsch derived lube base stock and (ii) lube base stock composed of alkylaromatics, alkylcycloparaffins or combinations thereof. This blended lube base oil increases the overall yield of lube base oil from the Fischer Tropsch facility as well as provides a lube base oil with moderate improvements in physical properties, for example, improvement in additive solubility.

For example, in one aspect, the present invention provides a process for making alkylaromatics by reforming the light boiling fractions of a Fischer Tropsch process. Furthermore, light aromatics from a Fischer Tropsch process can be converted to alkylaromatics by alkylation with olefins and alcohols. The olefins and alcohols used to alkylate the light aromatics can also be obtained from products of the Fischer Tropsch process. In yet another aspect of the invention, the present invention provides for a process for making alkylcycloparaffins by hydrogenating alkylaromatics obtained from a Fischer Tropsch process.

The highly paraffinic Fischer Tropsch lube base stock of the invention may be prepared by any means known to those of skill in the art. Preferably, the highly paraffinic Fischer Tropsch lube base stock may be prepared from Fischer Tropsch waxy fractions by catalytic hydroisomerization dewaxing processes. The hydroisomerization dewaxing processes use a molecular sieve to selectively hydroisomerize paraffins to isoparaffins.

Hydroisomerization dewaxing involves contacting a waxy hydrocarbon stream with a catalyst, which contains an acidic component, to convert the normal and slightly branched iso-paraffins in the waxy stream to other non-waxy species and thereby generate a lube base stock product with an acceptable pour point. The contacting of the waxy stream and catalyst is preferably carried out in the presence of hydrogen. Typical conditions under which the hydroisomerization process may be carried out include temperatures from about 200 to 400° C. and pressures from about 15 to 3000 psig, preferably 100 to 2500 psig. The liquid hourly space velocity during contacting is generally from about 0.1 to 20, preferably from about 0.1 to about 5. The hydrogen to hydrocarbon ratio falls within a range from about 1.0 to about 50 moles $H_2$ per mole hydrocarbon, more preferably from about 10 to about 20 moles $H_2$ per mole hydrocarbon. Suitable conditions for performing hydroisomerization are described in U.S. Pat. Nos. 5,282,958 and 5,135,638, the contents of which are incorporated by reference in their entirety.

Hydroisomerization dewaxing converts at least a portion of the waxy feed to non-waxy iso-paraffins by isomerization, while at the same time minimizing conversion by cracking. The degree of cracking is limited so that the yield of less valuable by-products boiling below the lube base oil range is reduced and the yield of lube oil is increased. Hydroisomerization generates a lube base oil with higher VI and greater oxidation and thermal stability.

In the hydroisomerization process, the waxy feed is contacted under isomerization conditions, preferably with an intermediate pore size molecular sieve having a crystallite size of no more than about 0.5 microns and pores with a minimum diameter of at least 4.8 Å and with a maximum diameter of 7.1 Å or less. The molecular sieve is of the 10- to 12-member ring variety. Specific molecular sieves which are useful in the hydroisomerization process of the present invention include zeolites ZSM-12, ZSM-21, ZSM-22, ZSM-23, ZSM-35, ZSM-38, ZSM-48, ZSM-57, SSZ-32, ferrierite and L and other molecular sieve materials based upon aluminum phosphates such as SAPO-11, SAPO-31, SAPO-41, MAPO-11 and MAPO-31. Such molecular sieves are described in U.S. Pat. Nos. 4,440,871, 5,282,958, and 5,135,638, the contents of which are herein incorporated by reference in their entirety. The hydroisomerization catalyst has sufficient acidity so that 0.5 g thereof when positioned in a tube reactor converts at least 50% of hexadecane at 370° C., a pressure of 1200 psig, a hydrogen flow of 160 ml/min., and a feed rate of 1 ml/hr. It also exhibits 40 or greater isomerization selectivity when used under conditions leading to 96% conversion of hexadecane to other chemicals. Isomerization selectivity, which is a ratio, is defined as:

$$\frac{\text{wt. \% branched } C_{16} \text{ in product}}{\text{wt. \% branched } C_{16} \text{ in product} + \text{wt. \% } C_{13-} \text{ in product}} \times 100$$

To achieve the desired isomerization selectivity, the catalyst includes a hydrogenation component which serves to promote isomerization. This hydrogenation component is a Group VIII metal; platinum and palladium are preferred.

The product of the hydroisomerization may be further treated by hydrofinishing. The hydrofinishing may be conventionally carried out in the presence of a metallic hydrogenation catalyst, for example, platinum on alumina. The hydrofinishing can be carried out at a temperature of from about 190° C. to about 340° C. and a pressure of from about 400 psig to about 3000 psig.

The highly paraffinic Fischer Tropsch lube base stocks prepared by the method of the present invention typically have a branching index of less than five, preferably less than 3, and have alkyl side branches with an average length of less than two carbon atoms. In addition, the highly paraffinic Fischer Tropsch lube base stocks and oils of the present invention have a viscosity of greater than 3 cSt when measured at 40° C. and preferably greater than 4 cSt. The highly paraffinic Fischer Tropsch lube base stocks will generally boil above 230° C. (450° F.) more usually above 315° C. (600° F.). In the invention, the Fischer Tropsch lube base stocks are used to make Group III and Group II lube base oils.

Integrated Process

The FIGURE illustrates an exemplary system for conducting the processes of the present invention using feedstocks from Fischer Tropsch processes to obtain the products desired for the blended lube base oil of the present invention. In the FIGURE, a blended lube base oil is prepared through the use of an integrated process. The blended lube base oil comprises a highly paraffinic Fischer Tropsch lube base stock blended with alkylaromatics boiling in the lube base oil range, alkylcycloparaffins boiling in the lube base oil range, or mixtures thereof.

The FIGURE illustrates a process for making alkylaromatics and alkylcycloparaffins from Fischer Tropsch products with additional alkylaromatics generated by alkylation of light aromatics. In one aspect of the invention as shown in the FIGURE, the highly paraffinic lube base oil is prepared by hydroisomerization dewaxing of a Fischer Tropsch waxy stream.

The Fischer Tropsch waxy stream used as a feedstock in this process generally will be a $C_{20+}$ feedstock and generally will boil above 600° F. The Fischer Tropsch waxy stream 155 is utilized as the feedstock to the optional hydrotreating step 160, in combination with hydrogen 157. The resulting hydrotreated product 165 or the Fischer Tropsch waxy stream 155 is fed into the hydroisomerization dewaxing zone 170, which contains a hydroisomerization catalyst. Hydrogen 167 is added to the hydroisomerization zone and the Fischer Tropsch waxy stream is subjected to hydroisomerization dewaxing. The hydroisomerization is conducted using hydroisomerization conditions and catalysts, as described above. The hydroisomerization process produces a highly paraffinic lube base stock 175. The resulting highly paraffinic lube base stock contains more than about 70 wt. % paraffins, preferably more than 80 wt. % paraffins, and most preferably more than 90 wt. % paraffins.

In one aspect of the invention, hydroisomerization of the Fischer Tropsch waxy stream is done in the presence of hydrogen utilizing an intermediate pore size molecular sieve. The molecular sieve is of the 10- to 12-member ring variety. Specific molecular sieves, which are useful in the hydroisomerization process of the present invention, include zeolites and other molecular sieve materials based upon aluminum phosphates, as described above. The catalyst includes at least one Group VIII metal, preferably platinum or palladium, with platinum most commonly used.

The conditions for hydroisomerizing the Fischer Tropsch waxy stream typically will be temperatures between 200–400° C., pressures from about 15–3000 psig, LHSV from about 0.1 and 5, and $H_2$:oil rates between 200 and 10,000 SCFB (preferably between 1000 and 4000 SCFB). Preferably a fixed bed catalytic reactor is used, preferably in down-flow operation.

Since the feedstock to the hydroisomerization step may contain olefins and oxygenates which can be poisons for hydroisomerization catalysts, the Fischer Tropsch waxy stream may be hydrotreated prior to hydroisomerization, and the water from the conversion of the oxygenates removed, typically by distillation (not shown). In this aspect of the invention, the Fischer Tropsch waxy stream 155 is fed into a hydrotreating zone 160 and is subjected to hydrotreating. The hydrotreating step is conducted using conventional hydrotreating conditions. Typical hydrotreating conditions vary over a wide range. In general, the overall LHSV is about 0.25 to 2.0, preferably about 0.5 to 1.0. The hydrogen partial pressure is greater than 200 psia, preferably ranging from about 500 psia to about 2000 psia. Hydrogen re-circulation rates are typically greater than 50 SCF/Bbl, and are preferably between 1000 and 5000 SCF/Bbl. Temperatures range from about 300° F. to about 750° F., preferably ranging from 450° F. to 600° F.

Catalysts useful in hydrotreating operations are well known in the art. Suitable catalysts include noble metals from Group VIIIA (according to the 1975 rules of the International Union of Pure and Applied Chemistry), such as platinum or palladium on an alumina or siliceous matrix, and unsulfided Group VIIIA and Group VIB, such as nickel-molybdenum or nickel-tin on an alumina or siliceous matrix. The non-noble metal (such as nickel-molybdenum) hydrogenation metals are usually present in the final catalyst composition as oxides, or more preferably or possibly, as sulfides when such compounds are readily formed from the particular metal involved. Preferred non-noble metal catalyst compositions contain in excess of about 5 weight percent, preferably about 5 to about 40 weight percent molybdenum and/or tungsten, and at least about 0.5, and generally about 1 to about 15 weight percent of nickel and/or cobalt determined as the corresponding oxides. The noble metal (such as platinum) catalyst may contain in excess of 0.01 percent metal, preferably between 0.1 and 1.0 percent metal. Combinations of noble metals may also be used, such as mixtures of platinum and palladium.

The matrix component may be of many types including some that have acidic catalytic activity. Ones that have activity include amorphous silica-alumina or may be a zeolitic or non-zeolitic crystalline molecular sieve. Examples of suitable matrix molecular sieves include zeolite Y, zeolite X and the so called ultra stable zeolite Y and high structural silica:alumina ratio zeolite Y. Suitable matrix materials may also include synthetic or natural substances as well as inorganic materials such as clay, silica and/or metal oxides such as silica-alumina, silica-magnesia, silica-zirconia, silica-thoria, silica-berylia, silica-titania as well as ternary compositions, such as silica-alumina-thoria, silica-alumina-zirconia, silica-alumina-magnesia, and silica-magnesia zirconia. The latter may be either naturally occurring or in the form of gelatinous precipitates or gels including mixtures of silica and metal oxides. Naturally occurring clays which can be composited with the catalyst include those of the montmorillonite and kaolin families. These clays can be used in the raw state as originally mined or initially subjected to calumniation, acid treatment or chemical modification. More than one catalyst type may be used in the reactor.

After the highly paraffinic lube base stock 175 is removed from the hydroisomerization dewaxing zone 170, it is blended with alkylaromatics boiling in the lube base oil range to obtain a blended lube base oil having a viscosity of greater than 3 cSt when measured at 40° C.

The alkylaromatics boiling in the lube base oil range used in the blended lube base oil of the present invention may be obtained from any source, but are preferably obtained from alkylation of light aromatics from the Fischer Tropsch process with light Fischer-Tropsch products containing olefins and/or alcohols. As shown in the integrated process of the FIGURE, alkylaromatics boiling in the lube base oil range 127 are prepared by alkylation 110 of light aromatics 107 with light Fischer-Tropsch products containing olefins and/or alcohols 105.

Light aromatics refer to aromatic-containing streams that have a relatively light boiling range such that they cannot be blended into the Fischer Tropsch waxy stream or into the highly paraffinic lube base stock without causing the lube base stock's flash point to drop below the specification minimum. The actual composition and boiling range of the light aromatics will depend on the specific lube base stock. Typically, the light aromatics are streams that contain benzene, toluene, and xylenes, with a total aromatic content of >30 wt %, preferably >60 wt %, and most preferably >80 wt %. Since benzene has health concerns, and xylenes have valuable uses as petrochemical feedstocks, the preferred light aromatic stream contains toluene at greater than 30 wt %, preferably greater than 60 wt %, and most preferably greater than 80 wt %.

The olefins may be formed, for example, by a thermal cracking process on a feedstock obtained from conventional or Fischer Tropsch processes. Where the feedstock to the thermal cracking process is derived from a Fischer Tropsch product, it preferably may be a heavy Fischer Tropsch product. The olefins and alcohols preferably are derived from the Fischer Tropsch process. Deriving the olefins and alcohols from the Fischer Tropsch process serves two benefits. First, it removes them from the feedstock that would be reformed which reduces the amount of potential reforming catalyst poisons in this stream. Second, it provides a method of converting light fractions that would not normally be in the lube base oil boiling range into the lube base oil boiling range increasing the overall yield of lube base oil. The light Fischer Tropsch products containing olefins and/or alcohols may be alkylated in alkylation zone 110 and the alkylation products 115 are separated, typically by distillation, in distillation zone 120. The alkylation and distillation steps may be performed by conventional methods using conventional parameters known to those of skill in the art to produce light by-products, alkylaromatics boiling in the lube base oil range and a reformable Fischer Tropsch product.

Typically, and in all practical forms of aromatic alkylation, some form of an acid catalyst is used. These may be of any number of types from bulk acids (sulfuric, hydrofluoric), solid acids (zeolites, acid clays, and/or silica-alumina), and more recently ionic liquids. The conditions for the alkylation depend on the specific nature of the acid, aromatic, and the olefin and/or alcohol. Typically with hydrofluoric acid or ionic liquids, the temperature will be between room temperature and about 75° C. With solid acid catalysts (zeolites and acid clays) the temperature will be between 100 and 300° C., preferably between 150 and 200° C. When alcohols are in the feedstock, they will form water as a by-product from the reaction. In this case the use of solid acid catalysts is preferred since liquid acid catalysts would eventually become diluted with the water product from the reaction. The molar ratio of aromatics to olefin and/or alcohols may be between 0.2 and 20. To avoid oligomerization of the olefins and/or alcohol, preferably the molar ratio of the aromatic to olefins and/or alcohol is greater than 1, and most preferably between 2 and 15. Pressures typically are sufficiently high to maintain the mixture in the liquid phase. The reaction is exothermic, and typically it is done in stages with heat removed in between the stages. The reactors may be either CSTR-type (preferably for liquid acids), ebulating bed, or fixed bed (preferably for solid catalysts). Such processes for alkylating aromatics are well known in the art.

The preferred method for this invention is the use of a solid acid catalyst in a fixed bed reactor with stages that permit intermediate heat removal. The molar ratio of aromatic to olefins and/or alcohol preferably is between 4 and 12. The average reactor temperatures preferably are between 150 and 200° C.

Light by-products 123, typically hydrocarbons boiling at or below n-pentane, are removed from the distillation zone 120, and the alkylaromatics boiling in the lube base oil range 127 produced may be fed to a blending zone for use in a blended lube base oil 180. The remaining reformable Fischer Tropsch product 125 may be fed to reforming zone 140 for reforming. Optionally before reforming, the reformable Fischer Tropsch product may be fed to a hydrotreating zone 130, in combination with hydrogen 147, and hydrotreated to remove unwanted chemical species to produce a hydrotreated stream 135. After subjecting the reformable Fischer Tropsch product 125 or the hydrotreated stream 135 to reforming in the reforming zone 140, the product streams from the reforming zone will include: (i) a light aromatic stream 107, which may be recycled to the alkylation zone 110 to prepare additional alkylaromatics boiling in the lube base oil range and (ii) a stream of aromatics for sale or other uses 145.

Catalytic reforming or AROMAX® technologies may be used to convert the reformable Fischer Tropsch product or a hydrotreated naphtha to aromatics. Catalytic reforming is well known to those of skill in the art. For example, it is described in the book, Catalytic Reforming, by D. M. Little, Penn Well Books (1985). Further, the AROMAX® Process is well known to those of skill in the art, and is described, for example, in Petroleum & Petrochemical International, Volume 12, No. 12, pages 65 to 68, as well as U.S. Pat. No. 4,456,527 to Buss et al.

In one aspect of the invention shown in the FIGURE, all or a portion of the alkylaromatics boiling in the lube base oil range produced in separation/distillation zone 120 may be fed to hydrogenation zone 150, in combination with hydrogen 147, and hydrogenated to form alkylcycloparaffins 153. The conditions of hydrogenation are well known in the industry and include reacting the alkylaromatics with hydrogen and a catalyst at temperatures above ambient and pressures greater than atmospheric. Preferable conditions for the hydrogenation include a temperature between 300 and 800° F., most preferably between 400 and 600° F., a pressure between 50 and 2000 psig, most preferably between 100 and 500 psig, a liquid hourly space velocity (LHSV) between 0.2 and 10, most preferably between 1.0 and 3.0, and a gas rate between 500 and 10,000 SCFB, most preferably between 1000 and 5000 SCFB.

The catalysts for use in hydrogenation zone are those typically used in hydrotreating, but non-sulfided catalysts containing Pt and/or Pd are preferred, and it is preferred to disperse the Pt and/or Pd on a support, such as alumina, silica, silica alumina, or carbon. The preferred support is alumina. Hydrogen for the hydrogenation can be supplied from the reforming zone 140, or from the synthesis gas used to produce the Fischer Tropsch product, or from steam reforming of methane-containing steams.

The alkylcycloparaffins boiling in the lube base oil range 153 produced in hydrogenation zone 150 may then be utilized in a blended lube base oil with other products from the process, such as with alkylaromatics boiling in the lube base oil range 127 from the distillation zone 120 and highly paraffinic lube base stock 175 obtained from the hydroisomerization zone 170. The blending of these components may be conducted by any of the methods known to those of skill in the art.

The blended lube base oils of the present invention generally comprise at least one highly paraffinic lube base stock and at least one lube base stock composed consisting of alkylaromatics, alkylcycloparaffins and combinations thereof. The highly paraffinic lube base stock generally will have a branching index of less than about 5, preferably less than about 4 and most preferably less than about 3.

Typically, the highly paraffinic lube base stock will contain more than about 70 weight % of paraffins. Preferably, the highly paraffinic lube base stock will contain more than about 80 weight % paraffins and most preferably more than about 90 weight % paraffins.

The alkylaromatics boiling in the lube base oil range useful in the blends of the invention typically will include alkylbenzenes, alkylnaphthalenes, alkyltetralines, or alkylpolynuclear aromatics. Preferably, the alkylaromatics will comprise alkylbenzenes. Additionally, in one aspect of the invention, these alkylaromatics will have low sulfur and nitrogen contents, for example, less than 100 ppm, preferably less than 10 ppm, and most preferably less than 1 ppm.

The alkylcycloparaffins boiling in the lube base oil range useful in the blends of the invention typically will include alkylcyclohexanes, alkylcyclopentanes, alkyldicycloparaffins, alkylpolycycloparaffins and mixtures thereof. Preferably, the alkylcycloparaffins will include alkylcyclohexanes, alkylcyclopentanes and mixtures thereof. In one aspect of the invention, these alkylcycloparaffins will have low sulfur and nitrogen contents, for example, less than 100 ppm, preferably less than 10 ppm, and most preferably less than 1 ppm.

The blended lube base oils of the present invention generally will have about 99 wt. % to about 50 wt. % highly paraffinic lube base stock and about 1 wt. % to about 50 wt. % alkylaromatics, alkylcycloparaffins, or mixtures thereof. Preferably, the blended lube base oil of the present invention will have about 99 wt % to about 75 wt % highly paraffinic lube base stock and about 1 wt % to about 25 wt % of alkylaromatics, alkylcycloparaffins or mixtures thereof. Generally, where both alkylaromatics and alkylcycloparaffins are added to the blended lube base oil, the ratio of alkylaromatic to alkylcycloparaffin is about 0.1:1 and 10:1.

The blended lube base oils of the invention may include additional lube base oil additives such as detergents, dispersants, antioxidants, antiwear additives, pour point depressants, viscosity index improvers, friction modifiers, antifoamants, corrosion inhibitors, wetting agents, densifiers, fluid-loss additives, rust inhibitors, and the like. For example, a finished lube oil formulator typically takes various viscosity grade lube base stock products and blends them with additives, such as those listed above, to make a finished lubricant that has a desired viscosity and physical properties.

These lube base additives typically have polar functionality. Due to the high paraffin content of Fischer Tropsch lube base stocks, the lube base additives may be insoluble, or only slightly soluble, in the Fischer Tropsch lube base stocks. To address the problem of poor additive solubility in highly paraffinic base stocks, various co-solvents, such as synthetic esters, are currently used. However, these synthetic esters are very expensive, and thus the blends of the highly paraffinic lube base oils containing synthetic esters, which have acceptable additive solubility, are also expensive.

The highly paraffinic Fischer Tropsch lube base stocks blended with alkylaromatics, alkylcycloparaffins, or mixtures thereof have been found to have a moderate improvement in physical properties. For example, addition of alkylaromatics, alkylcycloparaffins, or mixtures thereof to highly paraffinic Fischer Tropsch lube base stocks may impart desirable properties to Fischer Tropsch derived base oils, including, for example, oxidation stability, solubility, elastomer compatibility, hydrolytic stability, improved solvency of gums, improved solvency of lubricant oxidation products, and a moderate improvement in additive solubility.

For example, a finished lubricant with acceptable additive solubility is one in which the turbidity generally is below two NTUs. A lubricant comprising (i) at least one highly paraffinic Fischer Tropsch derived lube base stock, (ii) at least one lube base stock composed of alkylaromatics, alkylcycloparaffins, or mixtures thereof, and (iii) one or more lube base oil additive requires "an effective amount of synthetic ester co-solvent" to provide a finished lubricant with a turbidity of below two NTUs. The "effective amount of synthetic ester co-solvent" is an amount of ester co-solvent required to reduce the turbidity of the lubricant to below two NTUs. The "effective amount of synthetic ester co-solvent" is an amount that is less than the amount of ester co-solvent that would be required to reduce the turbidity to below two NTUs if the lubricant did not contain at least one lube base stock composed of alkylaromatics, alkylcycloparaffins, or mixtures thereof. The "effective amount of synthetic ester co-solvent" is an amount that is less than the amount of ester co-solvent that would be required to reduce the turbidity to below two NTUs of a lubricant comprising only lube base oil additives and highly paraffinic Fischer Tropsch derived lube base stocks. Therefore, a moderate improvement in additive solubility reduces the amount of expensive synthetic esters that are added to Fischer Tropsch lube base oils to formulate a finished lubricant with acceptable additive solubility. If the amount of synthetic esters needed is reduced, the cost of lubricants formulated with Fischer Tropsch lube base stocks is also reduced.

In a particularly preferred aspect of the invention, the blended lube base oils meet the specifications of a Group III or Group II lube base oil. The blended lube base oils prepared according to the present invention have excellent viscosity and viscosity index properties and a low pour point. The blended lube base oils of the invention have viscosity indexes above 80 and the viscosity indexes may be above 120. The blended lube base oils of the invention have a viscosity of greater than 3 cSt when measured at 40° C. The blended lube base oils have a pour point below 10° F., and generally between 60° F. and 0° F. The blended lube base oils of the invention also have a sulfur of less than 300 ppm, preferably less than 100 ppm, more preferably less than 10 ppm, and most preferably less than 1 ppm.

The following examples are given to illustrate the invention and should not be construed to limit the scope of the invention.

EXAMPLES

Example 1

Preparation

A $C_{20-24}$ alkylbenzene was prepared by alkylating internally isomerized $C_{20-24}$ NAO with benzene over HF acid. A 4 cSt Fischer Tropsch derived lube base oil was prepared from Co-based Fischer Tropsch wax. The wax was fractionated to obtain a 745–890° F. boiling portion. This fraction was processed by selective hydroisomerization dewaxing and hydrotreating in an integrated two-stage operation under the following conditions:

Catalytic dewaxing: 700° F., 1150 psig, 0.4 LHSV, 5000 SCF/B gas rate, with a Pt-SAPO-11 catalyst.

Hydrotreating: 450° F., 1135 psig, 1.0 LHSV, 5000 SCF/B gas rate with a Pt on silica alumina hydrogenation catalyst.

The resulting product was fractionated and a 4 cSt product was isolated.

A $C_{20-24}$ alkylcyclohexane was prepared by hydrogenating a portion of the $C_{20-24}$ alkylbenzene at 450° F., 1.25 WHSV, 2000 psig, and 5000 SCFB using a Pt on silica alumina hydrogenation catalyst. Physical properties of all these products are shown in the following Table I.

TABLE I

| | WOW 6629 4 cSt FTBO | NGQ 8302 $C_{20-24}$ Alkylbenzene | NGQ 8461 $C_{20-24}$ alkylhexane |
|---|---|---|---|
| Properties: | | | |
| API Gravity | 42.0 | 33.7 | 36.6 |
| Vis @ 40° C., cSt | 16.63 | 17.68 | 21.14 |
| Vis @ 100° C., cSt | 4.010 | 4.0018 | 4.5260 |
| VI | 144 | 128 | 130 |
| Pour Pt, ° C. | −22 | | 1 |
| Cloud Pt, ° C. | −8 | | 9 |
| ASTM D2887 Sim Dist: WT % | | | |
| St (0.5) | 677 | 715 | 681 |
| 5 | 698 | 744 | 749 |
| 10 | 711 | 755 | 761 |
| 20 | 733 | 761 | 768 |
| 30 | 752 | 765 | 771 |
| 40 | 770 | 768 | 775 |
| 50 | 789 | 776 | 785 |
| 60 | 809 | 794 | 801 |
| 70 | 833 | 800 | 806 |
| 80 | 860 | 805 | 814 |
| 90 | 893 | 835 | 846 |
| 95 | 917 | 1010 | 1022 |
| EP (99.5) | 970 | 1045 | 1064 |

To avoid problems with additive compatibility with highly paraffinic lube base oils, esters are frequently added at about 10 wt %. A commercial ester from Mobil Oil Company, identification number DB-51 (IE 1053), was obtained for comparative purposes.

Example 2

Additive Solubility Measurements

A commercial mixed additive source from Lubrizol designated 5186B (IOA 00643) was obtained. This additive is typically mixed with base stocks at about 1.25 wt % to from lubricants used for industrial oil applications. This additive was added to the lube base stocks in Example 1 and their blends. Prior to blending, the lube base stock was heated to 120° F., and afterwards, the mixture was allowed to cool to room temperature for evaluation. The lube base stock-additive mixtures were then evaluated for compatibility by the following two methods: (i) a rating of their overall appearance, and (ii) a measure of their turbidity.

The measure of the appearance was performed by placing fifty grams of a representative sample in a clear 4-Oz glass bottle of the type used for ASTM D1500. A 6 inch piece of cardboard containing a 4 inch by 1 inch rectangular, centered hole is mounted 2 to 4 inches in front of the flood lamp. The sample is placed in front of the rectangular opening. While the sample bottle is held vertically, and without disturbing the sample, the presence of sediment is noted first. Next the bottom of the sample bottle is examined for sediment. If sediment is found, the sample has failed the test and, a note of the time in the oven is recorded. If there is no sediment, the sample is examined for cloudiness, floc and haze. Floc is a suspension of small particles, and the presence of floc is also considered as a failure. The ratings for cloudiness, floc and haze are performed against a standard. Satisfactory materials will not have floc, sediment, cloudiness, or haze. The samples are given ratings as follows:

1 Bright, No cloud, No sediment

2 Slight Cloud

6 Contains floc (fails)

7 Contains sediment (fails)

Turbidity is generally measured by using a turbidity meter, such as a Hach Co. Model 2100 P Turbidimeter. A turbidity meter is a nephelometer that consists of a light source, which illuminates a water/lube base oil sample, and a photoelectric cell, which measures the intensity of light scattered at a 90° angle by the particles in the sample. A transmitted light detector also receives light that passes through the sample. The signal output (units in nephelometric turbidity units or NTUs) of the turbidimeter is a ratio of the two detectors. Meters can measure turbidity over a wide range from 0 to 1000 NTUs. The instrument must meet US-EPA design criteria as specified in US-EPA method 180.1.

Typical lube base oils measured at 75° F. have ranges from 0–20 NTUs. Commercial Poly Alpha Olefins (PAOs) tend to have NTUs between 0–1. Both of these oils have cloud points at or below the typical values of 14° F. (−10° C.).

When the appearance of the oils is examined (in simulation of a customer's opinion) the following relates the value of the NTU and the appearance:

| NTU Value | Appearance |
|---|---|
| 20 | Cloudy |
| 2–5 | Possibly acceptable, but noticeable haze |
| 0.5–2 | Clear and bright |

References:
drinking water must be <1.0
recreational water must be <5.0

Materials with turbidities below 2, preferably below 1, are desired. The turbidities were measured using a Hach Co. Model 2100 P Turbidimeter on the lube base stock-additive mixtures.

The results of additive solubility experiments are as summarized in the following Table II.

TABLE II

Blends with 4 cSt FTBO

| Lube Base Stock | Other Components | Additive amount, wt % | Initial Appearance | Turbidity, NTU |
|---|---|---|---|---|
| FT 4 cSt Base Oil | None | None | 1 | 0.64 |
| FT 4 cSt Base Oil | None | 1.25 wt % | 2/7 | 56.0 |
| FT 4 cSt Base Oil | 5% Ester | None | 1 | 0.57 |
| FT 4 cSt Base Oil | 5% Ester | 1.25 wt % | 7 | 2.41 |
| FT 4 cSt Base Oil | 10% $C_{20-24}$ alkylbenzene | None | 1 | 0.82 |
| FT 4 cSt Base Oil | 2.5% $C_{20-24}$ alkylbenzene | 1.25 wt % | 2/6/7 | 51.3 |
| FT 4 cSt Base Oil | 5% $C_{20-24}$ alkylbenzene | 1.25 wt % | 2/6/7 | 39.5 |
| FT 4 cSt Base Oil | 10% $C_{20-24}$ alkylbenzene | 1.25 wt % | 2/6/7 | 30.6 |
| FT 4 cSt Base Oil | 10% $C_{20-24}$ alkylcyclohexane | None | 1 | 0.64 |
| FT 4 cSt Base Oil | 2.5% $C_{20-24}$ alkylcyclohexane | 1.25 wt % | 2/6/7 | 57.4 |
| FT 4 cSt Base Oil | 5% $C_{20-24}$ alkylcyclohexane | 1.25 wt % | 2/6/7 | 50.0 |
| FT 4 cSt Base Oil | 10% $C_{20-24}$ alkylcyclohexane | 1.25 wt % | 2/7 | 50.5 |

The results demonstrate that adding the standard additive package to the Fischer Tropsch provides a product that is significantly more turbid than the product from a PAO (NTU of 56 versus 5.77). Adding the synthetic ester to the sample of Fischer Tropsch base oil and additive can reduce the turbidity significantly. Adding alkylcycloparaffins and alkylaromatics to the sample of Fischer Tropsch base oil and additive also can moderately reduce the turbidity. In samples containing Fischer Tropsch base oil and additive, alkylaromatics result in a greater reduction in turbidity than alkylcycloparaffins. Use of alkylcycloparaffins, alkylaromatics, or mixtures thereof may reduce the amount of expensive, synthetic ester required to reach a desired level of turbidity.

What is claimed is:

1. A process for preparing a blended lube base oil comprising the steps of:

a) blending:

i) at least one highly paraffinic Fischer-Tropsch derived lube base stock having a viscosity of greater than 3 cSt when measured at 40° C., having a branching index of less than 5, and having an average length of alkyl side branches of less than 2 carbon atoms; and ii) at least one base stock composed of alkylaromatics, alkylcycloparaffins, or mixtures thereof and having a viscosity of greater than 2 cSt when measured at 40° C., wherein base stock (ii) is present in an amount of from about 1 wt % to about 50 wt %; and b) isolating the blended lube base oil.

2. The process of claim 1, wherein the base stock of (ii) is obtained from a Fischer-Tropsch process.

3. The process of claim 2, wherein the base stock of (ii) is essentially 100 wt. % alkylaromatics, alkylcycloparaffins or mixtures thereof.

4. The process of claim 2, further comprises blending:

iii) one or more lube base oil additives selected from the group consisting of detergents, dispersants, antioxidants, antiwear additives, pour point depressants, viscosity index improvers, friction modifiers, demulsifiers, antifoamants, corrosion inhibitors, wetting agents, densifiers, fluid-loss additives, and rust inhibitors; and iv) an effective amount of synthetic ester co-solvent to reduce turbidity of the blended lube base oil to below two NTUs.

5. The process of claim 2, wherein the base stock of (ii) is obtained by alkylating aromatics from a Fischer Tropsch process with a light Fischer Tropsch feedstock containing olefins and alcohols to form alkylaromatics boiling in the lube base oil range.

6. A process for preparing a blended lube base oil comprising the steps of:

a) alkylating aromatics with a light feedstock containing olefins and alcohols to form alkylaromatics boiling in the lube base oil range;

b) (b) subjecting Fischer Tropsch derived waxy streams to hydroisomerizing conditions to form highly paraffinic lube base stock; and c) (c) blending the alkylaromatics and the highly paraffinic lube base stock to form a blended lube base oil wherein the blended lube base oil has a viscosity of greater than 3 cSt when measured at 40° C.

7. A process according to claim 6, wherein the alkylaromatics are present in the blended lube base oil in an amount of from about 1 wt % to about 25 wt %.

8. A process according to claim 6, further comprising the steps of subjecting at least a portion of the alkylaromatics boiling in the lube base oil range to hydrogenation under catalytic hydrogenating conditions to form alkylcycloparaffins boiling in the lube base oil range and blending the alkylcycloparaffins with the alkylaromatics and the highly paraffinic lube base stock to form a blended lube base oil.

9. A process according to claim 6, wherein the alkylaromatics are alkylbenzenes.

10. A process according to claim 9, wherein at least a portion of the alkylbenzenes are subjected to hydrogenation to obtain alkylcyclohexanes.

11. A process according to claim 6, further comprising the step of subjecting a reformable Fischer Tropsch product to reforming under catalytic reforming conditions to form additional aromatics for alkylating.

12. A process according to claim 11, further comprising the step of subjecting the reformable Fischer Tropsch product to hydrotreatment under catalytic hydrotreating conditions prior to reforming.

13. A process according to claim 12, wherein the aromatics and the light feedstock are derived from a Fischer Tropsch process.

14. A process according to claim 13, wherein the olefins are selected from the group consisting of olefins formed by a thermal cracking process, olefins formed from a thermal cracking process which uses a feed derived from a Fischer Tropsch process, and mixtures thereof.

15. A process according to claim 14, wherein the thermal cracking process utilizes a heavy Fischer Tropsch feed derived from a Fischer Tropsch process.

16. A process for increasing the yield of lube base oil from a Fischer Tropsch facility comprising the steps of:

a) performing Fischer-Tropsch synthesis on syngas to provide a product stream;

b) fractionally distilling the product stream and isolating a $C_{20+}$ fraction, an aromatics fraction, and a light feedstock containing olefins and alcohols;

c) subjecting the $C_{20+}$ fraction to hydroisomerizing conditions to form highly paraffinic lube base stock;

d) alkylating the aromatics with the light feedstock to form alkylaromatics boiling in the lube base oil range;

e) optionally subjecting a portion of the alkylaromatics from step (d) to hydrogenation under catalytic hydrogenating conditions to form alkylcycloparaffins boiling in the lube base oil range;

f) blending the alkylaromatics, optional alkylcycloparaffins, and the highly paraffinic lube base stock to form a blended lube base oil; and g) isolating the blended lube base oil.

17. A process according to claim 16, further comprising the steps of fractionally distilling and isolating a reformable light fraction; subjecting the reformable light fraction to reforming under catalytic reforming conditions to form additional aromatics for alkylating.

18. A process according to claim 17, further comprising the step of subjecting the reformable light fraction to hydrotreatment under catalytic hydrotreating conditions prior to reforming.

19. A process according to claim 16, further comprising the step of subjecting at least a portion of the $C_{20+}$ fraction to hydrotreatment under catalytic hydrotreating conditions prior to hydroisomerization.

20. A process for preparing a blended lube base oil comprising the steps of:

a) performing Fischer-Tropsch synthesis on syngas using a catalyst which provides low to moderate chain growth probabilities to provide a reformable light stream, an aromatics stream, and a light stream containing olefins and alcohols;

b) performing Fischer-Tropsch synthesis on syngas using a catalyst which provides high chain growth probabilities to provide a highly paraffinic $C_{20+}$ stream;

c) subjecting the $C_{20+}$ stream to hydroisomerizing conditions to form highly paraffinic lube base stock;

d) alkylating the aromatics stream with the light stream containing olefins and alcohols to form alkylaromatics boiling in the lube base oil range;

e) subjecting the reformable light stream to reforming under catalytic reforming conditions to form additional aromatics for alkylating;

f) optionally subjecting a portion of the alkylaromatics boiling in the lube base oil range to hydrogenation under catalytic hydrogenating conditions to form alkylcycloparaffins boiling in the lube base oil range;

g) blending the alkylaromatics boiling in the lube base oil range, optional alkylcycloparaffins boiling in the lube base oil range, and the highly paraffinic lube base stock to form a blended lube base oil; and h) isolating the blended lube base oil.

21. A process according to claim 20, further comprising the step of subjecting the reformable light fraction to hydrotreatment under catalytic hydrotreating conditions prior to reforming.

* * * * *